US008213650B2

(12) United States Patent
Fröhlich et al.

(10) Patent No.: US 8,213,650 B2
(45) Date of Patent: Jul. 3, 2012

(54) HEARING DEVICE WITH A VISUALIZED PSYCHOACOUSTIC VARIABLE AND CORRESPONDING METHOD

(75) Inventors: Matthias Fröhlich, Erlangen (DE); Matthias Latzel, Eggolsheim (DE); Henning Puder, Erlangen (DE); Andre Steinbuss, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1015 days.

(21) Appl. No.: 12/220,143

(22) Filed: Jul. 22, 2008

(65) Prior Publication Data

US 2009/0028362 A1 Jan. 29, 2009

(30) Foreign Application Priority Data

Jul. 27, 2007 (DE) ..... 10 2007 035 172

(51) Int. Cl.
*H04R 25/00* (2006.01)
*H04R 29/00* (2006.01)

(52) U.S. Cl. ..... 381/312; 381/314; 381/60

(58) Field of Classification Search ..... 381/23.1, 381/312–321, 58, 60
See application file for complete search history.

(56) References Cited

U.S. PATENT DOCUMENTS 5,710,819 A * 1/1998 Tøpholm et al. ..... 381/316
5,825,894 A * 10/1998 Shennib ..... 381/60
5,835,611 A * 11/1998 Kaiser et al. ..... 381/321
6,366,863 B1 * 4/2002 Bye et al. ..... 702/57
6,674,862 B1 * 1/2004 Magilen ..... 381/60
6,974,421 B1 * 12/2005 Causevic et al. ..... 600/561
7,018,342 B2 * 3/2006 Harrison et al. ..... 600/559
7,027,606 B2 * 4/2006 D'Agri ..... 381/312
7,194,100 B2 * 3/2007 Kuhnel et al. ..... 381/321
7,450,724 B1 * 11/2008 Greminger ..... 381/60
7,885,416 B2 * 2/2011 Chalupper et al. ..... 381/60
8,036,405 B2 * 10/2011 Ludvigsen et al. ..... 381/317
2002/0111745 A1 * 8/2002 Bye et al. ..... 702/19
2004/0008849 A1 * 1/2004 Moller ..... 381/60
2008/0056518 A1 * 3/2008 Burrows et al. ..... 381/314
2008/0165980 A1 * 7/2008 Pavlovic et al. ..... 381/60
2009/0028363 A1 * 1/2009 Frohlich et al. ..... 381/309
2009/0034767 A1 * 2/2009 Beck et al. ..... 381/312
2009/0074195 A1 * 3/2009 Cornell et al. ..... 381/58

(Continued)

FOREIGN PATENT DOCUMENTS

DE 10231406 A1 * 1/2004

(Continued)

*Primary Examiner* — Edgardo San Martin

(57) ABSTRACT

The setting and/or adjustment of a hearing device for a user is provided. The hearing device includes a signal processing facility for processing an input sound to form an output sound, with a perceptive model being implemented in the signal processing facility or in a processing facility connected in a data link therewith, with which perceptive model a psychoacoustic variable can be provided in respect of the output sound. A visualization facility, for instance integrated in a remote control comprising the processing facility, is preferably wirelessly connected to the signal processing facility. A value of the psychoacoustic variable can thus be visualized accordingly. In this way an assisting person obtains an item of information relating to the perception of the sound supplied by the hearing device by the user, as a result of which the setting is facilitated for the assisting person.

10 Claims, 2 Drawing Sheets

U.S. PATENT DOCUMENTS

2009/0154745 A1* 6/2009 Latzel ..... 381/314
2009/0238370 A1* 9/2009 Rumsey et al. ..... 381/58
2010/0098262 A1* 4/2010 Frohlich ..... 381/60
2010/0098276 A1* 4/2010 Frohlich et al. ..... 381/314
2010/0104123 A1* 4/2010 Steinbuss ..... 381/317
2010/0202636 A1* 8/2010 Frohlich et al. ..... 381/314
2010/0254538 A1* 10/2010 Latzel ..... 381/23.1

FOREIGN PATENT DOCUMENTS

DE 10308483 A1 9/2004
EP 0661905 A2 7/1995
EP 1676529 A1 7/2006

* cited by examiner

HEARING DEVICE WITH A VISUALIZED PSYCHOACOUSTIC VARIABLE AND CORRESPONDING METHOD

CROSS REFERENCE TO RELATED APPLICATIONS

This application claims priority of German application No. 10 2007 035 172.2 DE filed Jul. 27, 2007, which is incorporated by reference herein in its entirety.

FIELD OF INVENTION

The present invention relates to a hearing device with a signal processing facility for processing an input sound to form an output sound, with a perceptive model being implemented in the signal processing facility, with which a psychoacoustic variable can be provided in respect of the output sound. The present invention also relates to a corresponding method for operating a hearing device. A hearing device is understood here also to mean a headset, earphones or other systems which can be worn on the ear.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with an external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

The publication US 2002/0111745 A1 discloses a wearable hearing analysis system. Parameters of a hearing response can be obtained here by means of audiometers. A response prediction is used to perform a basic setting of a hearing device.

The publication EP 0 661 905 A2 also describes a method for adjusting a hearing device and a corresponding hearing device. A psychoacoustic variable, in particular the loudness, is obtained using a perceptive model on the one hand for a standard group of people and on the other hand for a single individual. Control details are determined on the basis of the difference of the two psychoacoustic variables, whereby the signal transmission to a hearing device is configured or set ex situ and/or is conveyed in situ.

The publication EP 1 676 529 A1 also describes a method for visualizing the hearing ability and/or hearing sensitivity. Here at least one hearing dimension, like for instance the loudness perception, is made visible by means of an image by changing at least one image parameter, like for instance the brightness. A loudness curve obtained on the basis of audiometric measurements is used to control the brightness distribution in an image. If necessary, several loudness curves are also determined in different frequency ranges and the coloring of an image is thus controlled. The visual assistance significantly simplifies the acoustician's task of finding an optimum setting.

SUMMARY OF INVENTION

The hearing device supply for people with multiple disabilities or however the supply for children is essentially based on the assisting persons being involved in the adjustment process and also in the subsequent aftercare process. These persons also play a significant role in the daily surroundings of the hearing system wearer and potentially also adjust parameters of a hearing device, like for instance the loudness of the hearing device, for the hearing-impaired. They are only assigned here to empirical values. However, they do not know which problem the hearing-impaired person actually has. Their interferences into the hearing device setting are thus not necessarily correct.

The object of the present invention thus consists in facilitating the setting or the adjustment of a hearing device for a user or for a person assisting the user.

This object is achieved in accordance with the invention by a hearing device with a signal processing facility for processing an input sound to form an output sound, with a perceptive model being implemented in the signal processing facility or in a processing facility which is connected in a data link therewith, with which perceptive model a psychoacoustic variable can be provided in respect of the output sound, with a visualization facility being connected to the signal processing facility or the processing unit in order to visualize a value of the psychoacoustic variable.

Provision is also made in accordance with the invention for a method for operating a hearing device by processing an input sound to form an output sound in a hearing device and providing a psychoacoustic variable in respect of the output sound with the aid of a perceptive model by means of the hearing device, as well as visualizing a value of the psychoacoustic variable in/on the hearing device.

It is thus advantageously possible to optically display a psychoacoustic variable, which specifies how the user perceives a sound, so that it is possible particularly for persons assisting the hearing-impaired to render the setting of the hearing device(s) as pleasant as possible for the user.

Since the signal processing facility in the hearing device provides the psychoacoustic variables, it is not necessary to transmit a wideband signal to an external device for visualization purposes, which firstly calculates a psychoacoustic variable therefrom with the aid of a perceptive model.

It is also particularly advantageous if the hearing device includes a remote control, which contains the visualization unit and the processing facility. Since hearing devices are already operated in many cases with a remote control, no additional device for the visualization is thus necessary, thereby facilitating use of the hearing device. With a hearing system of this type, the hearing device and the remote control each have a communication facility, with which the respective current value of the psychoacoustic variable provided by the signal processing facility can be transmitted from the hearing device to the remote control for optical display purposes.

According to a development, several psychoacoustic variables can be provided by the signal processing facility or the processing facility and the corresponding values can be visualized by the visualization facility. If applicable, several values can be visualized at the same time. The sound quality and speech intelligibility can thus be visualized at the same time for instance, so that the user or the assisting person is able to find a compromise for these variables, if these influence one another oppositely.

According to a further embodiment, the hearing device can include an analysis facility for analyzing the current hearing situation, so that at least one psychoacoustic reference value can be generated from corresponding analysis values with the perceptive model of the signal processing facility or processing facility irrespective of a setting of the signal processing facility, which is optically displayed by the visualization facility together with a psychoacoustic value relating to a current setting of the signal processing facility. In addition to the current psychoacoustic value, it is also possible in this way also to optically display a maximum value and a minimum value for instance, if necessary also an average value, which result from the current hearing situation, as a result of which the person performing the setting obtains evidence for the setting process.

Provision can also be made for a further hearing device for supplying the left and right ear of a user in addition to the hearing device, with the signal processing facility being arranged in one of the two hearing devices and the perceptive model providing a psychoacoustic variable in respect of binaural perception on the basis of signals of both hearing devices. It is possible as a result to facilitate the setting and/or adjustment of a hearing device also in respect of binaural perception. In particular, the directional effect of a hearing device can be more easily optimized in this way for the user.

BRIEF DESCRIPTION OF THE DRAWINGS

The present invention is described in more detail with reference to the appended drawings, in which.

DETAILED DESCRIPTION OF INVENTION

The exemplary embodiments illustrated in more detail below represent preferred embodiments of the present invention.

Figure 1:
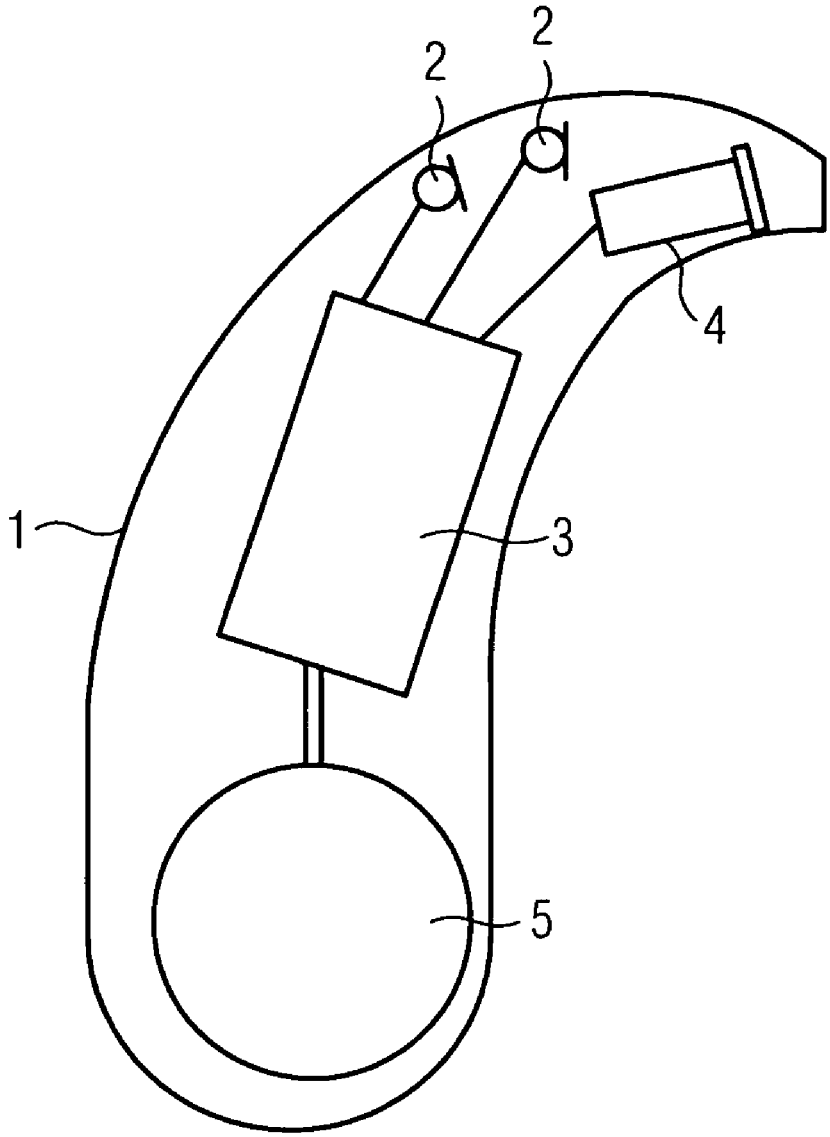
FIG 1 (Prior art)
FIG. 1 shows the basic design of a hearing device according to the prior art and FIG. 2 shows a schematic view of an inventive hearing system with two hearing devices and a remote control for visualization purposes.
Figure 2:
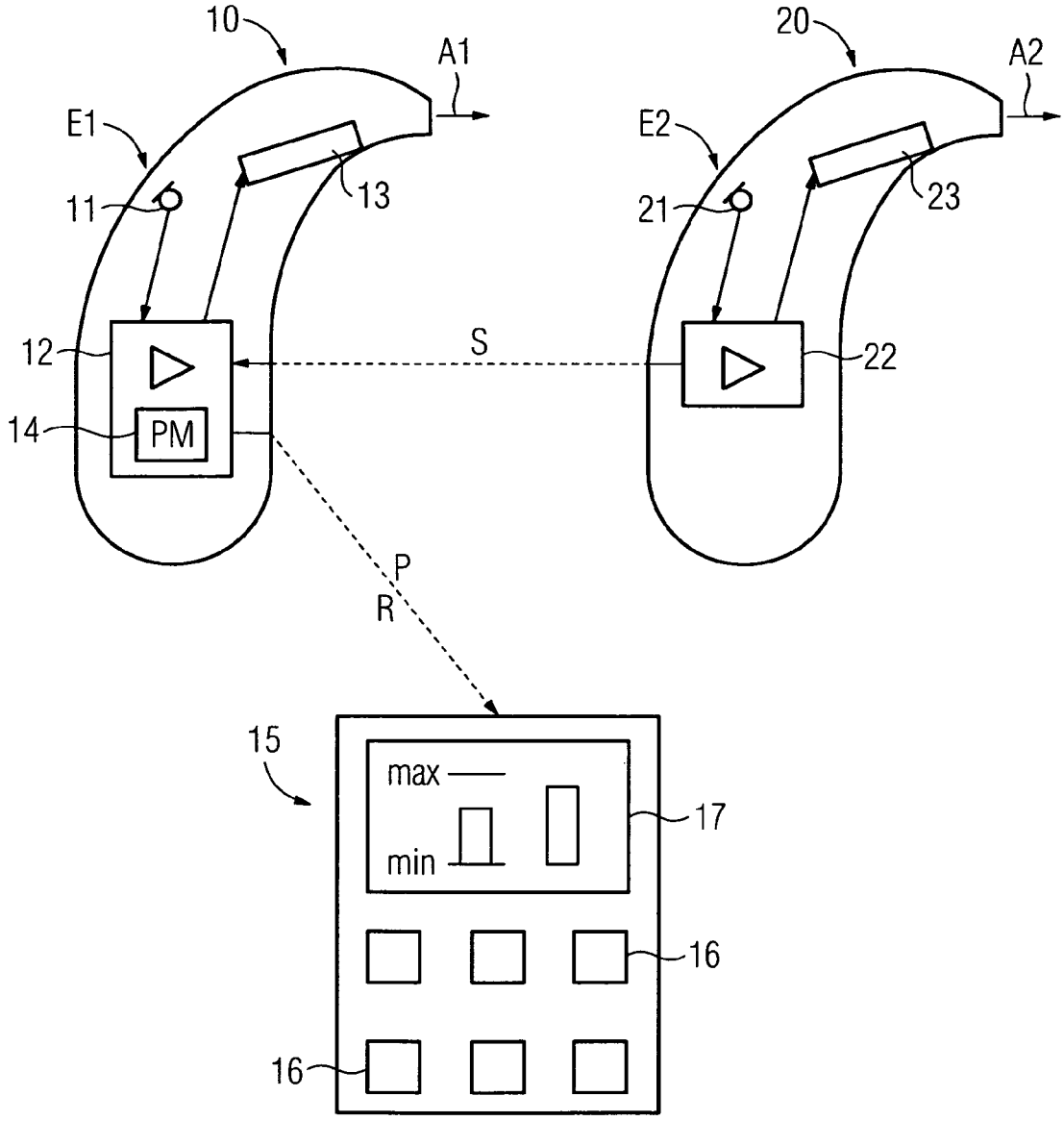

In the example in FIG. 2, a hearing system with a first hearing device 10 is shown, which has an internal signal processing facility for converting an input sound E1 into an output sound A1. The signal processing facility is symbolized by a microphone 11, an amplifier module 12 and a receiver 13. A perceptive model 14 is implemented in the amplifier module 12, which contains a digital processor. Psychoacoustic characteristics, such as loudness, convenience, hearing effort et al. can be provided as a function of the output signal A1 and/or a correspondingly modulated signal. A psychoacoustic variable of this type is identified in FIG. 2 with P. It can be transmitted to a computer, a television or another device for visualization purposes in a wired or wireless fashion.

The calculation of the psychoacoustic variable favorably takes place in the hearing device, so that the preferably wireless transmission of data can take place with a low bit rate. If the analysis is on the other hand performed externally, e.g. in the remote control, the entire signal must firstly be transmitted with a high bandwidth.

In the example in FIG. 2, the psychoacoustic variable P and/or the corresponding value is transmitted from the hearing device 10 via a wireless interface (not shown) to a remote control 15. In addition to some operating elements 16, this has a small screen 17 as a visualization facility. If applicable, a one-dimensional display beam consisting of a row of LEDs or suchlike is also sufficient for visualization purposes. In the present example, the screen 17 is able to display the values of several psychoacoustic variables P, which are provided by the hearing device 10.

In the present example, the amplifier component 12 of the hearing device 10 is also able to analyze and/or classify the current hearing situation. The hearing device is thus able to send reference data R to the remote control 15 in respect of one or several psychoacoustic dimensions, so that the display can be scaled especially to the hearing situation for instance. The reference data R may however also be used to provide evidence to the person performing the setting as to the range in which the respective acoustic variable can actually be changed in the hearing situation. It is possibly favorable to display the corresponding minimum and maximum value in respect of a psychoacoustic variable. For instance, a sound source will never be able to be perceived with an average loudness, if it is positioned far from or very close thereto. This can be graphically symbolized to the person performing the setting by means of reference values, which are independent of the hearing device setting and objectively evaluate the hearing situation, so that he/she does not search for an improved setting in vain.

If a hearing device wearer has impaired hearing on both sides, he/she can also be supplied binaurally using a second hearing device 20. FIG. 2 likewise symbolically displays a second hearing device 20 of this type. Like the first hearing device 10, it has a signal processing facility consisting of a microphone 21, an amplifier module 22 and a receiver 23. In principle, a perceptive model could likewise be implemented in the amplifier module 22, said perceptive module transmitting a psychoacoustic variable to the remote control 15 for visualization purposes. The psychoacoustic variable could similarly be transmitted from the second hearing device 20 also to the first hearing device 10. This monaural psychoacoustic variable may then be used if necessary with a monaural psychoacoustic variable of the first hearing device 10 with the aid of a perceptive model for binaural perception in order to calculate a binaural psychoacoustic variable. The latter is then transmitted again to the remote control. Depending on requirements, monaural and binaural variables can thus be transmitted to the remote control for illustration purposes.

In the present example, the second hearing device 20 has no perceptive model and only a signal S, which represents the output sound and/or the output signal A2, is transmitted to the first hearing device 10. It is processed there in the perceptive model for binaural perception with other existing variables to form one or several psychoacoustic variables which are then transmitted to the remote control 15 for visualization purposes.

Alternatively, the perceptive model can also be implemented in a processing facility of the remote control 15. The corresponding signal or signals S representing the output signal or signals A1, A2 is/are then transmitted directly to the remote control 15. This then provides the psychoacoustic data to be visualized.

It is conceivable in the case of multiple disabilities to arrange a perception model, downstream of which the psychoacoustic data is used as an input parameter, for instance for haptical perception.

Assisting persons can use the variables offered by way of the perception of the hard-of-hearing to change the setting of the hearing system if necessary. Alternatively, it is also possible, on the basis of this information, to actively change the situation in order to positively change these psychoacoustic variables. Another seat for a hearing-impaired child in a school can thus be selected for instance.

The display of psychoacoustic characteristics also allows the hard-of-hearing to be assisted during audiotherapy. The hearing device wearer can namely even observe the displayed psychoacoustic variables and if necessary even actively adjust his/her acoustic surroundings. He/she can for instance select a different seat in a hall or close an open window. Reference data which is also visualized is also helpful here. It specifies what could actually be achieved in the different psychoacoustic dimensions in the present acoustic situation or in a generic, comparable situation.

The afore-described system and/or method advantageously allows psychoacoustic characteristics to be visualized in order to be able to offer objective information concerning the sensitivity of a hearing system wearer. As already illustrated above, two fields of application are particularly worth mentioning, namely their use with people with multiple disabilities or children in order to supply the assisting persons with previously inaccessible information or however the display of psychoacoustic characteristics for the hearing system wearer him/herself, e.g. within the scope of an audiotherapy.

The invention claimed is:

1. A hearing device system, comprising:

a hearing apparatus including a signal processing facility that processes an input sound to form an output sound;

a perceptive model that specifies how a user perceives sound implemented in the signal processing facility or implemented in a processing facility communicatively connected to the signal processing facility via a data link, the perceptive model calculating a value of a psychoacoustic variable based on a current setting of the signal processing facility in respect of the output sound;

an analysis facility that analyzes a current hearing situation to generate a psychoacoustic reference value irrespective of the current setting of the signal processing facility; and a visualization facility communicatively connected to the signal processing facility or the processing unit that displays the value of the psychoacoustic variable together with the psychoacoustic reference value for reference.

2. The hearing device system as claimed in claim 1, further comprises a remote control including the visualization facility and the processing facility.

3. The hearing device system as claimed in claim 2, wherein the hearing device and the remote control each include a communication facility, with which the respective current value of the psychoacoustic variable provided by the signal processing facility is transmitted from the hearing device to the remote control for optical display purposes.

4. The hearing device system as claimed in claim 1, wherein several psychoacoustic variables are provided from the signal processing facility or processing facility and at the same time the corresponding values are visualize from the visualization facility.

5. The hearing device system as claimed in claim 1, wherein the psychoacoustic reference value displayed by the visualization facility together with the psychoacoustic value relating to the current setting of the signal processing facility comprises corresponding minimum and maximum values of the psychoacoustic reference value to provide a view of a range that the psychoacoustic variable can be changed.

6. The hearing device system as claimed in claim 1, which has two hearing apparatuses for supplying the left and right ear of a user, with the signal processing facility being arranged in one of the two hearing apparatuses and the perceptive model providing a psychoacoustic variable in respect of binaural perception on the basis of signals from both hearing apparatuses.

7. A method for operating a hearing device, comprising:

processing via a current setting of a signal processing facility an input sound to form an output sound in the hearing device;

providing a value of a psychoacoustic variable in respect of the output sound that specifies how a user perceives sound based on the current setting of the signal processing facility with the aid of a perceptive model via the hearing device;

analyzing a current hearing situation to generate a psychoacoustic reference value irrespective of the current setting of the signal processing facility; and displaying the value of the psychoacoustic variable together with the psychoacoustic reference value for reference.

8. The method as claimed in claim 7, wherein several psychoacoustic variables are provided by the hearing device and the corresponding values being simultaneously visualized.

9. The method as claimed in claim 7, wherein the psychoacoustic reference value displayed together with the psychoacoustic value relating to the current setting of the hearing device comprises corresponding minimum and maximum values of the psychoacoustic reference value to provide a view of a range that the psychoacoustic variable can be changed.

10. The method as claimed in claim 7, wherein a second hearing device supplies the left and right ear of a user being provided in addition to the hearing device and the perceptive model supplying a psychoacoustic variable in respect of binaural perception for the visualization on the basis of signals of both hearing devices.

* * * * *